United States Patent [19]

Gregoire

[11] 4,338,087

[45] Jul. 6, 1982

[54] COMBINED WEB JAW AND BIGHT STRIPPER

[75] Inventor: Clyde G. Gregoire, Bensenville, Ill.

[73] Assignee: Baldwin-Gregg, Inc., Lyons, Ill.

[21] Appl. No.: 224,624

[22] Filed: Jan. 12, 1981

[51] Int. Cl.[3] ..... B65H 45/16

[52] U.S. Cl. ..... 493/425; 493/432; 101/409

[58] Field of Search ..... 493/424–433; 271/277; 101/409–410

[56] References Cited

U.S. PATENT DOCUMENTS

| | | | |
|---|---|---|---|
| 2,703,238 | 3/1955 | Hand | 493/433 |
| 4,073,485 | 2/1978 | Gregoire et al. | 270/21 |
| 4,113,243 | 9/1978 | Gregoire et al. | 270/21 |

OTHER PUBLICATIONS

U.S. Patent Application Ser. No. 202599, filed 10-3-1-80, Clyde G. Gregoire.

*Primary Examiner*—Edgar S. Burr

*Assistant Examiner*—A. Heinz

*Attorney, Agent, or Firm*—Kenneth T. Snow

[57] ABSTRACT

A folding device for printed continuous webs moving at a high rate of speed. The device includes a pair of cooperating rolls between which the web passes. The rolls carry "working boxes" on the surfaces thereof to perform various folding functions on the moving web. Here the function of concern is the gripping of the web. An element on one roll causes the web to be pushed into open gripping elements on the cooperative roll. A bight is formed in the web at the position of gripping. During the concurrent rotation of the rolls the grippers close on the formed bight. Subsequently it is desired to remove the bight from the opening gripping elements. Simultaneously with the opening of the gripping elements there is provided a positive means for raising the formed bight out of the scope of the jaws. This bight stripper prevents any unnecessary entanglements of the fast moving printed web with the gripping elements during the folding of the web.

4 Claims, 6 Drawing Figures

COMBINED WEB JAW AND BIGHT STRIPPER

BACKGROUND OF THE INVENTION

1. Field of the Invention

The present invention is allied to the printing industry and is directed to the folding of a relatively wide printed web at speeds equal to the speeds of printing presses. Printed webs may therefore be delivered directly from printing presses to the folding machines of this invention without any slow-up from the commencement of the printing to and through to the folded and finished book or booklet. The web folding machine employs cooperative rollers having working boxes on the outer cylindrical surfaces thereof with various devices in the working boxes to effect web gripping, web releasing, web cutting, etc. utilized in the folding operation. It is the purpose of the instant invention to effectively strip a web bight from the web gripping mechanism to ensure there will be no undesired hangups of the fast moving printed webs around the cooperative rollers.

2. Description of the Prior Art

Web bight gripping devices are shown and described in my prior U.S. Pat. Nos. 4,073,485 and 4,113,243. These prior devices employ rods with radial arms to effect an opening and a closing of the gripping devices. In the wider gripping devices for comparably wider printed webs the torque effect of the operating rods is such that it becomes more and more difficult to effect a uniform closing of the gripper throughout the wide web.

Positive uniform gripping of a wide web has now been accomplished in the device shown in my copending application, Ser. No. 202,599, filed Oct. 31, 1980, and entitled CAM OPERATED GRIPPERS FOR PRINTED WEBS. It is to this device of this copending application that the present bight stripper has been incorporated. The bight stripper is constructed to move with the movable jaw in an in and out movement relative to a stationary jaw. Further, with the same energizing force effecting operation of the movable jaw the bight stripper is also moved relatively to the movable jaw. The bight stripper is equal in level to the movable jaw when the jaw is closed, but the bight stripper raises substantially when the movable jaw is open to thereby positively lift the web bight from the grippers during the opening of the movable jaw.

SUMMARY OF THE INVENTION

A principal object of the present invention is to provide a novel stripper for the bight of a printed web simultaneously with the opening of bight gripping jaws.

An important object of this invention is to provide a novel printed web gripper with a cooperative web bight stripper.

Another important object of this invention is to provide a novel transverse gripper for a relatively wide printed web and including therewith a means for stripping the transverse bight in the printed web simultaneously with the opening of the gripper and energized by the same means utilized to effect the opening and the closing of the gripper.

Another and further important object is to provide the novel device as set forth in the preceding object and further including a cam operator for effecting a raising of the stripper at least as high as the depth of the formed bight.

Another and still further improvement object of this invention is to provide a novel combination web bight gripper and stripper wherein the stripper moves with a movable jaw of the gripper in an opening and closing of the gripper and further moves vertically relative to the movable jaw.

A still further important object of this invention is to provide the novel device of the preceding object and further including a plurality of angularly disposed cam elements interposed between the movable jaw and an endwise moving actuator, and a plurality of angularly disposed cam elements interposed between the bight stripper and the endwise moving actuator, and the angularly disposed cam elements between the bight stripper and the actuator disposed at generally right angles to the plurality of angularly disposed cam elements between said moving jaw and the actuator.

Other and further important objects and advantages will become apparent from the following description and accompanying drawings.

IN THE DRAWINGS

AS SHOWN IN THE DRAWINGS

Figure 2:
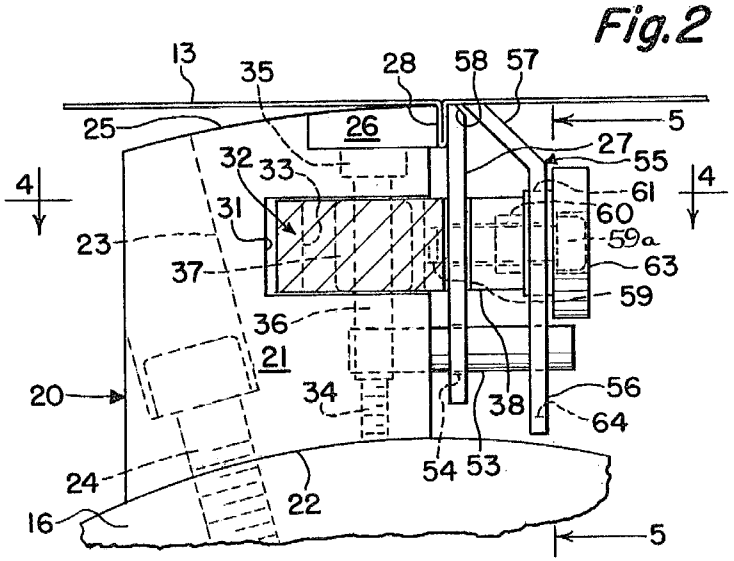
FIG. 2 is a sectional view taken through the working box on line 2—2 of FIG. 5.

This invention is an improvement and an advantage over the device of my copending application, Ser. No. 202,599, entitled CAM OPERATED GRIPPERS FOR PRINTED WEBS.

The reference numeral 10 indicates generally a frame for a folding machine used in the printing industry. The present device is concerned with a folding machine used in conjunction with a printing press and wherein a printed web from the printing press is delivered directly into a folding machine. This is similar to the devices shown in our previous U.S. Pat. Nos. 4,073,485 and 4,113,243 as well as the device of my copending application for U.S. patent, Ser. No. 202,599. As in each of the earlier devices the frame 10 includes generally parallel spaces apart walls 11 and 12. These walls provide the journal supports for a plurality of rollers or cylinders used in the folding of the printed web.

Figure 1:
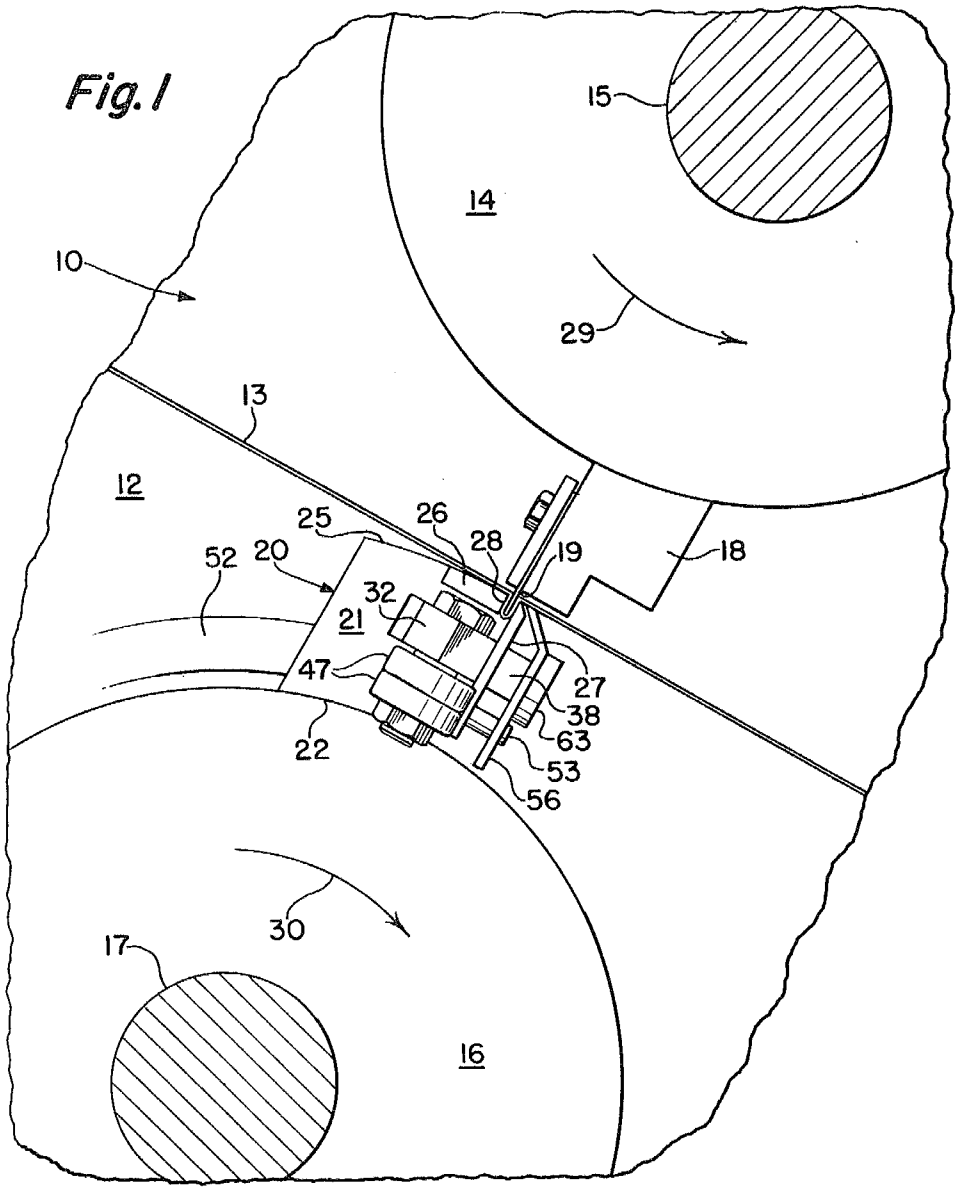
FIG. 1 is a vertical sectional view taken through a pair of cooperative operational rollers in the printed web folding machine.

As best shown in FIG. 1 a printed web 13 is delivered downwardly and laterally in a generally straight line between a pair of cooperative operational rollers which, as defined in our previous patents and my copending application, carry adjustably positioned working boxes on the cylindrical surfaces thereof. In the present instance a first operational roller 14 is mounted on a shaft 15 which is journally supported in the spaced end or side walls 11 and 12. A spaced apart second operational roller 16 is carried on a shaft 17 similarly journally supported in the spaced end walls 11 and 12. As the printed web 13 passes between these cooperative operational rollers 14 and 16 it is acted upon by the elements in the working boxes mounted on these operational rollers. The plural working boxes as shown in greater detail in my earlier U.S. Pat. Nos. 4,073,485 and 4,113,243 as well as my copending application for U.S. patent, Ser. No. 202,599 combine to effect a folding of the printed web 13.

A working box 18 is mounted on the roller 14 and is similar to the working boxes of my previous U.S. patents and copending application and particularly working box 26 of our U.S. Pat. No. 4,073,485. The working box 18 carries a radially disposed tucking blade 19 which is utilized to effect a tucking of the printed web 13 into a gripping device on the cooperative operational roller 16. The operational roller 16 carries a working box 20 directly opposite the working box 18 of the roller 14. The present invention is concerned with the gripping elements employed in this working box 20, including the opening and closing of the gripping jaws in combination with a bight stripper operating in conjunction with those opening and closing gripping jaws. The box 20 is constructed of a steel block 21 having a concavely curved underside 22 which is adapted to snuggly engage the outer cylindrical surface of the operational roller 16. The box further includes a generally radially cut passageway 23 to receive a bolt 24 to fasten the box 20 to the roller 16 in any desired arcuate position. In the present instance only one such bolt 24 has been illustrated but depending upon the transverse extent of the rollers used it is understood that any number of such bolts may be used at spaced apart positions to effect a secure fastening of the box to the roller. The working box 20 further includes a convexly shaped outer or top surface 25 which is generally concentric with the cylindrical surface of the operational roller 16. A stationary jaw 26 is inset in the block 21 along the top surface and adjacent the front side of the box which is defined as that side carrying a movable jaw 27. The movable jaw 27 cooperates with the stationary jaw 26 to grip a bight 28 of the printed web 13. The movable jaw 27 comprises a rectangularly shaped vertically disposed plate. It is the upper edge of the longer top side of the plate that is utilized as the gripper jaw and cooperates with the fixed stationary jaw 26 located in the top of the working box 20. The bight 28 is formed by the tucking blade member 19 pressing against the printed web and pushing the formed bight 28 into the open jaws of the gripper member as the operational rollers 14 and 16 rotate in the direction of the arrows 29 and 30.

Figure 3:
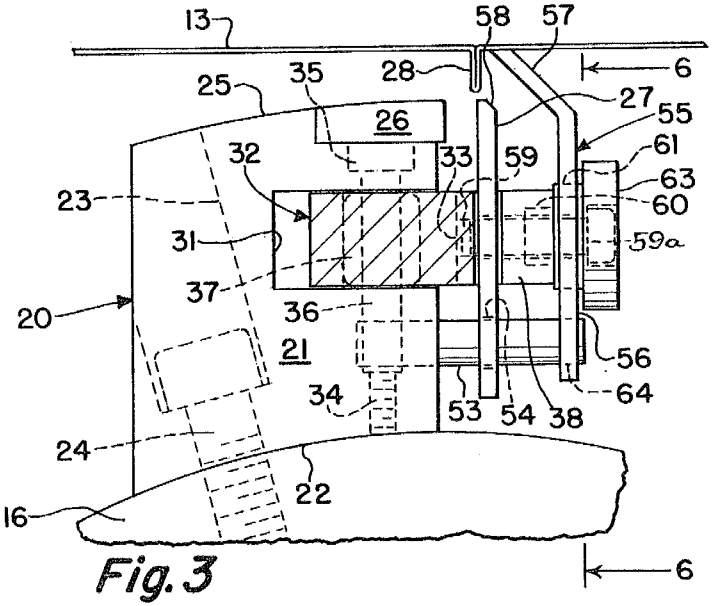
FIG. 3 is a vertical sectional view similar to that of FIG. 2 and taken on the line 3—3 of FIG. 6 to show the stripper removing the bight from the now opened jaws.
Figure 4:
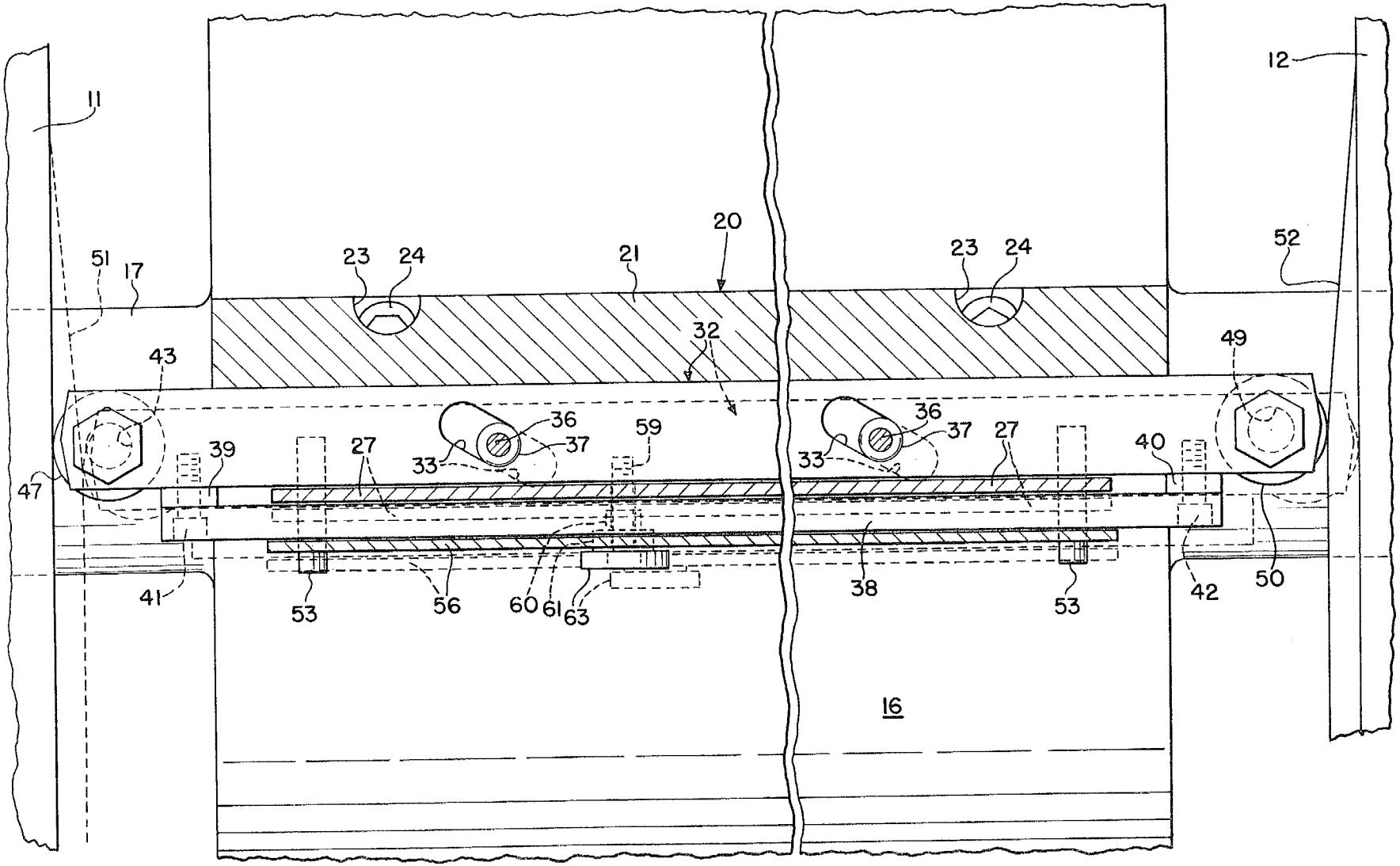
FIG. 4 is a sectional view taken on the line 4—4 of FIG. 2 to disclose the gripping jaws actuator mechanism.

The working box 20 is provided with a horizontally disposed elongated groove 31 in the block portion 21. The groove 31 is open at the front edge of the block. An elongated actuating member 32 is slidable endwise in the side open groove 31. A plurality of inclined cam slots 33 are provided at spaced intervals in the actuator member 32 as best shown in FIG. 4. Screws 34 are disposed vertically in the block 21 and threadedly engage the block as shown in FIGS. 2 and 3. The screws 34 are provided with enlarged heads 35 which are disposed beneath the stationary jaw 26. The screws 34 further include shanks 36 which act as bushings for the receipt of rollers 37 thereover. The rollers 37 are journally carried on the bushing shanks 36 and there is one such roller disposed within each of the inclined cam slots 36. The rollers 37 are thus in a fixed position in the block 21 and merely rotate on their fixed axes. As the elongated actuator member 32 moves endwise in the groove 31 the included inclined cam slots 33 cause the rollers 37 to ride upwardly and/or downwardly to in turn cause the movable jaw to be either opened or closed relative to the stationary jaw 26.

The working box 20 further includes an elongated bridge member 38 lying parallel with the actuator member 32 and the movable jaw 27. A spacer 39 just slightly greater in thickness than the thickness of the movable jaw 27 is located at one end of the bridge 38. The spacer 39 has its other side abutting the elongated actuator member 32. Similarly a spacer 40 of the same thickness as the spacer 39 is provided at the other end of the bridge 38 to thus provide a space between the actuator member 32 and the bridge 38.

A bolt 41 at one end of the bridge 38 passes through the bridge, through the spacer 39, and is threaded into the actuator member 32. Similarly a bolt 42 located at the other end of the bridge 38 passes through the bridge 38, through the spacer 40, and thence is threaded into the actuator member 32. With this construction the bridge 38, the spacers 39 and 40 and the actuator 32 move as a unit when the actuator member 32 is slid endwise in the groove 31 in the working box block 21. The rectangularly shaped movable jaw 27 thus has limited sliding freedom within the space defined between the actuator member 32 and the bridge 38 and between the end spacers 39 and 40.

Figure 5:
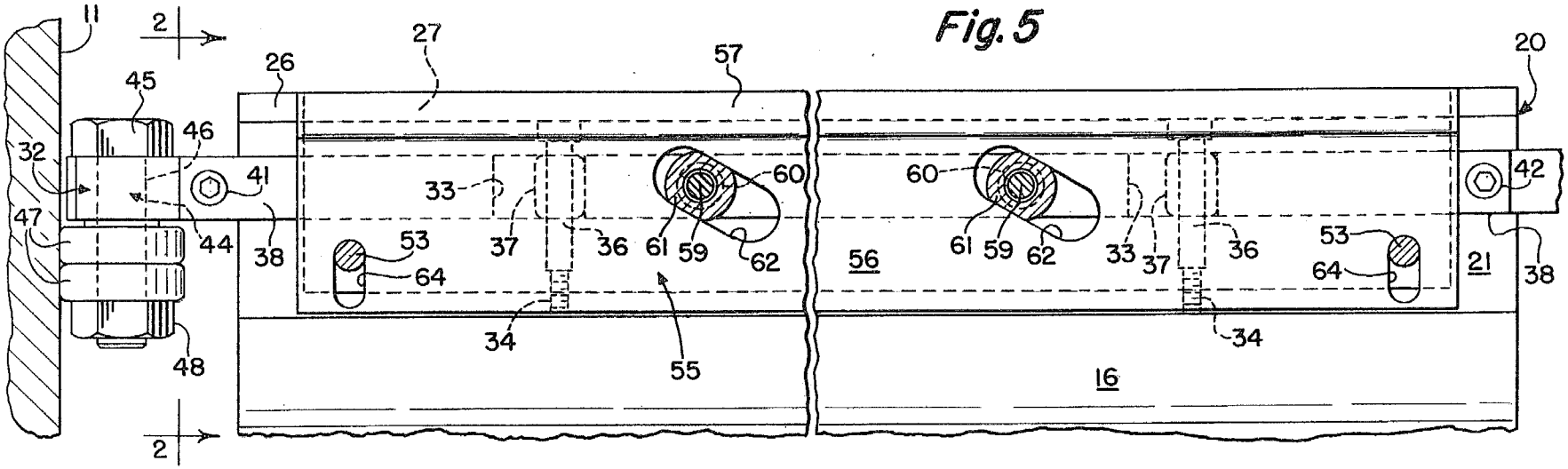
FIG. 5 is a sectional view taken on the line 5—5 of FIG. 2 and depicts the stripper in its down position at a time when the web gripping jaws are closed.
Figure 6:
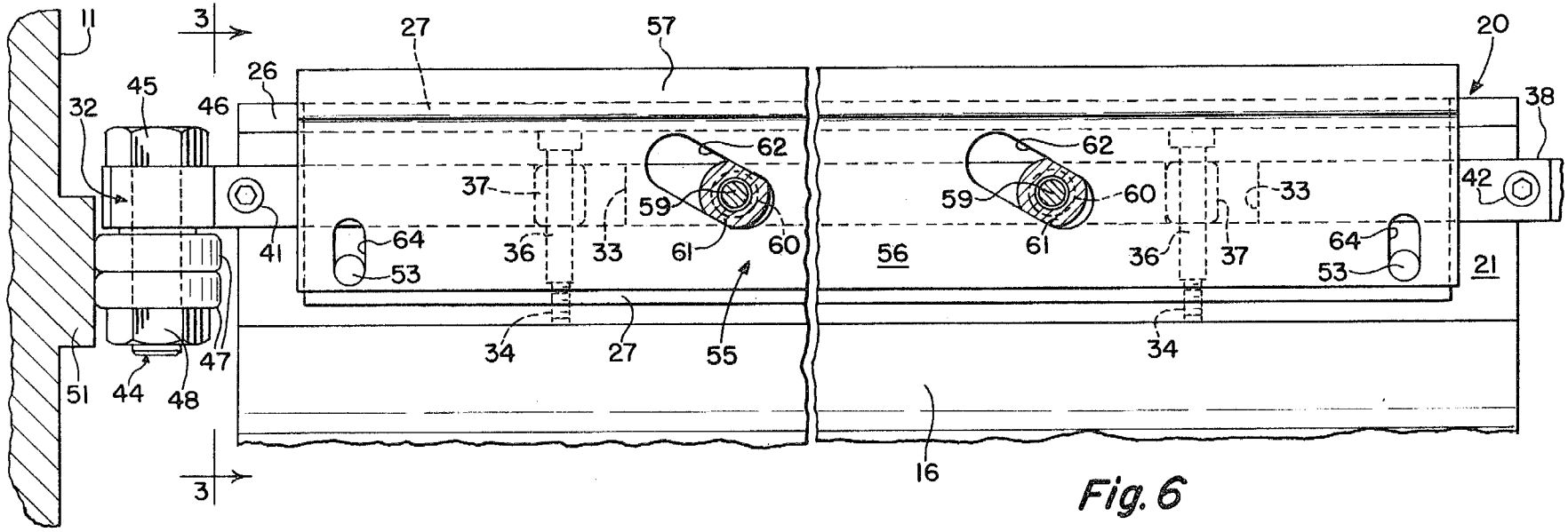
FIG. 6 is a sectional view taken on the line 6—6 of FIG. 3 and depicts the stripper in its up position at a time when the web gripping jaws are open.

As best shown in FIGS. 4, 5 and 6, a hole 43 is provided through the end of the actuator member 32 and receives a bolt 44 therethrough. The bolt 44 is provided with a head or nut 45 and a shank 46. Cam rollers 47 are journally carried on the shank 46 of the bolt 44. A nut 48 is threadedly engaged with the lower end of the bolt shank 46 to thereby confine the cam rollers 47 in a position adjacent the end of the actuator member 32. As further shown in FIGS. 4, 5 and 6 the rollers 47 are adapted to abut the end wall 11 of the folding machine of this invention. A hole 49, comparable to the hole 43, is provided in or adjacent the other end of the actuator member 32 and is the means for supporting cam rollers 50 on that other end of the actuator member 32. The mountng of the cam rollers 50 is the same as that shown and described for the rollers 47. An inclined cam 51 is provided on the inner surface of the end wall 11 and a comparable but arcuately offset inclined cam 52 is provided on the inner surface of the end wall 12. The particular positions of the cams 51 and 52 are determined by the desired timing of the opening and the closing of the gripper jaws. The operational roller 16 rotates within and between the walls 11 and 12. In the arcuate position of the roller 16 as shown in FIG. 4 the cam rollers 50 have ridden up on the inclined cam 52 causing the actuator member 32 to be moved as far to the left as possible. It is in this position of the actuator member 32 that the jaw 27 is closed against the stationary jaw 26. Continued rotation of the operational roller 16 permits the cam rollers 50 to ride off the cam 52 and at the proper time the cam rollers 47 ride up the inclined cam 51 on the end wall 11 thus causing the actuator member 32 to shift in a rightward direction to the dashed-line position of the actuator member 32 of FIG. 4. The dashed-line position of the actuator member 32 indicates the open position of the jaws of the gripper.

The rectangular plate forming the movable gripper jaw 27 is supported between the actuator member 32 and its spaced apart bridge 38 and thus moves in and out with respect to the stationary gripper jaw 26 when the actuator member 32 moves endwise. However, as the jaw plate 27 has slidable movement capabilities between the actuator member 32 and the bridge 38 it is necessary to employ means to confine it in this environment. As best shown in FIGS. 2, 3 and 4, spaced apart guide pins 52 are affixed at their inner ends into the block 21. Circular holes 54 are provided in the movable jaw 27 to slidably receive the comparably circularly shaped guide pins 53.

A bight stripper 55 comprises a vertically extending plate 56 and an inwardly angled top portion 57. The angled top 57 extends toward the top of the movable gripper jaw 27. In order to create a snug nesting arrangement the top of the movable jaw plate is beveled as shown at 58 at an angle comparable to the angle of the angled top 57 of the bight stripper. Bolts 59 threadedly engage the front side of the actuator member 32 and pass outwardly through the movable jaw plate 27 and thence through the vertical plate portion 56 of the bight stripper 55. A cylindrical sleeve 60 is journalled on each of the bolts 59. An element 61 appearing as a roller but with opposite flat sides is integral with the sleeve 60 over each of the bolts 59. A pluralty of inclined elongated slots 62 are provided in the vertical wall 56 of the bight stripper 55. A relatively large diameter head 63 is integral with the sleeve 60 and slide elements 61 and surrounds the outer end of each of the bolts 59. An enlarged head **59*a* of the bolt 59 is recessed with the head 63 and acts to hold the assembly in place. The elements 61 slide within the inclined elongated slots 62. This causes the bight stripper to rise and fall upon endwise movement of the actuator member 32**.

Vertically extending elongated slots 64 are provided in the vertical panel 56 of the bight stripper 55. These slots 64 receive the guide pins 53 and thus limit the movement of the bight stripper to a vertical movement relative to the movable jaw 27.

The rollers 37 to effect in and out jaw movement are disposed at right angles to the flat sided roller-like elements 61 used to effect up and down movement of the bight stripper 55. The guide pins 53 move from top to bottom of the elongated slots 64 as shown in FIGS. 5 and 6. The guide pins 53 prevent lateral shifting movement of the stripper 55.

Generally the bight stripper moves in and out conjointly with the movable jaw 27, but the bight stripper also moves vertically relative to the movable jaw as clearly shown in FIGS. 2 and 3. It is thus apparent that the bight 28 is securely gripped by the jaws in FIG. 2 and that the bight stripper is not interfering in any manner with the printed web 13. However, in FIG. 3 the jaw 27 has moved away from the stationary jaw 26 and simultaneously the bight stripper 55 has moved upwardly relative to the movable jaw causing the web and its included bight 28 to be shifted upwardly and entirely clear of the jaws and their working box 20. Thus the endwise movement of the actuator member 32 by the cams on the end walls 11 and 12 not only cause the jaws to open and close a the proper time in folding sequences but the bight formed by the gripping jaws is stripped free of the working elements and permits succeeding web folding operations to continue unhindered.

I am aware that various details of construction may be changed throughout a reasonable range without departing from the principles disclosed herein and I therefore do not propose limiting the patent granted hereon otherwise than as necessitated by the appended claims.

What is claimed is:

1. A combination web gripper and bight stripper for use in a web folder comprising a frame structure, a roller journaled for rotation in said frame structure, a working box carried transversely on the outer surface of said roller, the working box having a stationary jaw and a transversely endwise movable actuator, cam means on said frame structure for effecting endwise sliding of said actuator, a moving jaw, means guiding said moving jaw relative to said stationary jaw in a straight in movement toward said stationary jaw and a straight out movement away from said stationary jaw, a plurality of angularly disposed cam elements interposed between said moving jaw and said actuator to effect a movement of said moving jaw toward and away from said stationary jaw upon endwise movement of said actuator, a web bight stripper movable with said moving jaw toward and away from said stationary jaw, means guiding said bight stripper relative to said stationary jaw in a straight up and down movement separate from said movable jaw, a plurality of angularly disposed cam elements interposed between said bight stripper and said actuator to effect the separate movement of said bight stripper from a position substantially level with said moving jaw to a position spaced above said moving jaw upon endwise movement of said actuator.

2. A combination web gripper and bight stripper for use in a web folding comprising a frame structure including spaced apart walls, an operational roller journaled for rotation between said spaced apart walls of the frame structure, a working box carried transversely on the outer surface of said operational roller, the working box having a stationary jaw and a transversely endwise movable actuator, cam means on the inwardly facing surfaces of the spaced apart walls of said frame structure for effecting endwise sliding of said actuator, a moving jaw, pin means affixed to said stationary jaw and cooperating with receiving holes in said moving jaw to guide said moving jaw relative to said stationary jaw in a straight in and out movement, a plurality of angularly disposed cam elements interposed between said moving jaw and said actuator to effect a movement of said moving jaw toward and away from said stationary jaw upon cam effected endwise movement of said actuator, a web bight stripper movable in and out with said moving jaw, means guiding said bight stripper relative to said stationary jaw in a straight up and down movement separate from said movable jaw including said pin means affixed to said stationary jaw and cooperating with vertically disposed enlongated holes in said bight stripper, a plurality of angularly disposed cam elements interposed between said bight stripper and said actuator to effect the separate movement of said bight stripper from a position substantially level with said moving jaw to a position spaced vertically above said moving jaw upon endwise movement of said actuator, and said angularly disposed cam elements between said bight stripper and said actuator disposed at generally right angles to the plurality of said angularly disposed cam elements between said moving jaw and said actuator.

3. A device as set forth in claim 2 in which said moving jaw comprises a flat plate of generally rectangular shape and said bight stripper comprises a flat plate lower portion spaced from said moving jaw flat plate and a top portion angularly bent toward said moving jaw flat plate.

4. A device as set forth in claim 3 in which said moving jaw flat plate top is bevelled at an angle comparable to the angle of the top angularly bent portion of said bight stripper to permit a snug nesting of the tops of the moving jaw and bight stripper when the gripper is closed.

* * * * *